US011406169B2

(12) United States Patent
Genelot et al.

(10) Patent No.: US 11,406,169 B2
(45) Date of Patent: Aug. 9, 2022

(54) CONTAINER FOR A COSMETIC PRODUCT AND REFILL FOR SUCH A CONTAINER

(71) Applicant: Albea Services, Gennevilliers (FR)

(72) Inventors: Pascal Genelot, cir a+ee teau-Gontier (FR); Yuan Yu, Gennevilliers (FR)

(73) Assignee: Albea Services, Gennevilliers (FR)

( * ) Notice: Subject to any disclaimer, the term of this patent is extended or adjusted under 35 U.S.C. 154(b) by 0 days.

(21) Appl. No.: 17/015,041

(22) Filed: Sep. 8, 2020

(65) Prior Publication Data

US 2021/0068518 A1 Mar. 11, 2021

(30) Foreign Application Priority Data

Sep. 6, 2019 (FR) ..... 1909855
Jan. 20, 2020 (CN) ..... 202010065561.5

(51) Int. Cl.

| | |
|---|---|
| ***B43K 21/08*** | (2006.01) |
| ***A45D 40/16*** | (2006.01) |
| ***A45D 40/06*** | (2006.01) |
| ***A45D 40/12*** | (2006.01) |
| *A45D 40/00* | (2006.01) |
| *A45D 40/20* | (2006.01) |

(52) U.S. Cl.

CPC ..... *A45D 40/16* (2013.01); *A45D 40/06* (2013.01); *A45D 40/065* (2013.01); *A45D 40/12* (2013.01); *A45D 2040/0031* (2013.01); *A45D 2040/0043* (2013.01); *A45D 2040/208* (2013.01)

(58) Field of Classification Search

CPC ..... A45D 40/12; A45D 40/16; A45D 40/06; A45D 40/065; A45D 2040/0031; A45D 2040/0043; A45D 2040/208

See application file for complete search history.

(56) References Cited

U.S. PATENT DOCUMENTS

| | | | | |
|---|---|---|---|---|
| 6,012,863 | A * | 1/2000 | Sakurai | A45D 40/16 401/60 |
| 8,132,977 | B2 * | 3/2012 | Pires | A45D 40/06 401/88 |
| 8,328,445 | B2 * | 12/2012 | Martins | A45D 40/06 401/78 |
| 9,133,693 | B2 * | 9/2015 | Wasa Tverlid | E21B 43/106 |
| 9,723,907 | B2 * | 8/2017 | Huang | A45D 40/14 |
| 2018/0249809 | A1 | 9/2018 | Crawford et al. | |
| 2021/0068517 | A1 * | 3/2021 | Trochel | A45D 40/16 |

* cited by examiner

*Primary Examiner* — Jennifer C Chiang
(74) *Attorney, Agent, or Firm* — CRGO Global; Steven M. Greenberg

(57) ABSTRACT

A refill intended to be removably mounted on an actuation base includes a cosmetic product stick and a sleeve inside which the stick is movably mounted. The sleeve is closed by at least one lid. The refill further includes an actuation unit making it possible for retraction and/or extension of the cosmetic product stick, the sleeve extending along the actuation unit so as to prevent its actuation.

12 Claims, 6 Drawing Sheets

[Fig.1]
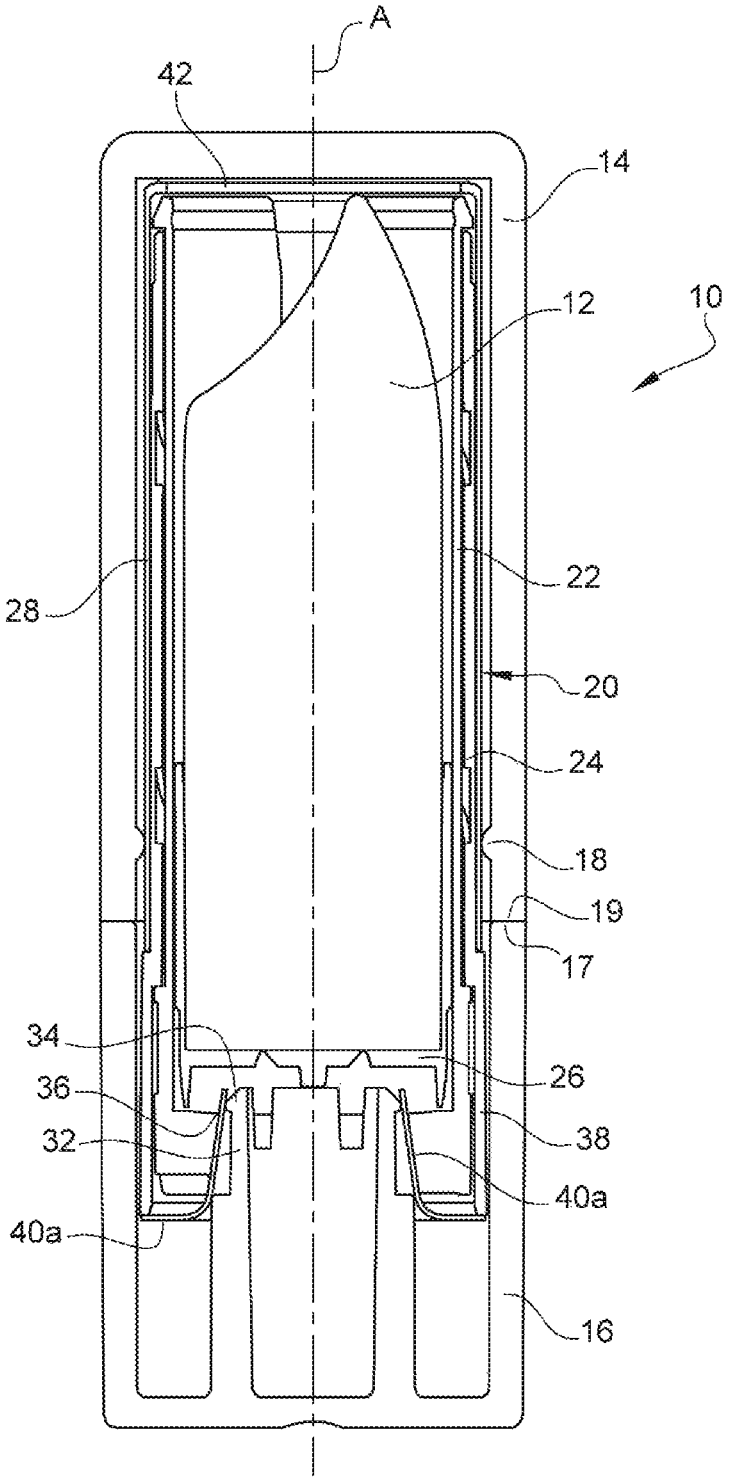

[Fig.2]
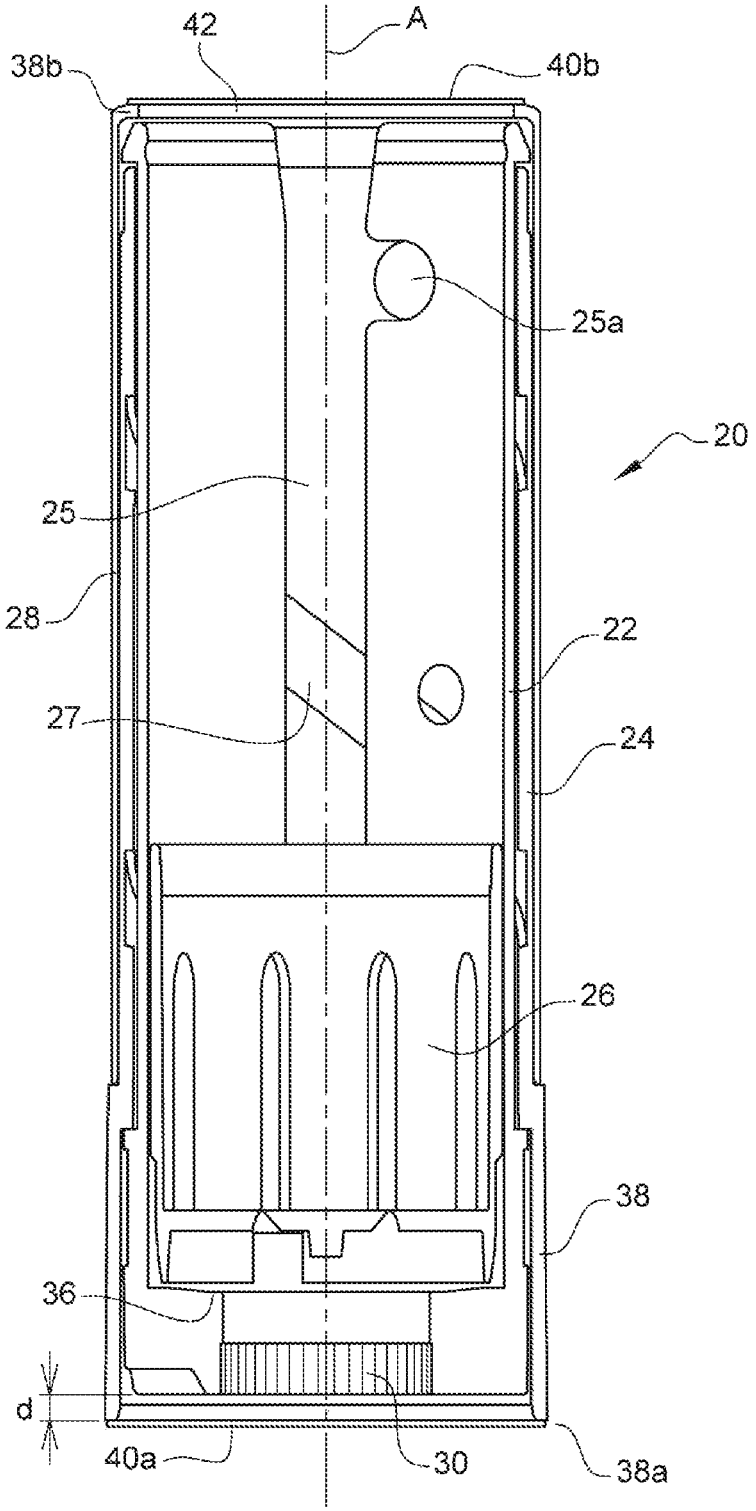

[Fig.3]
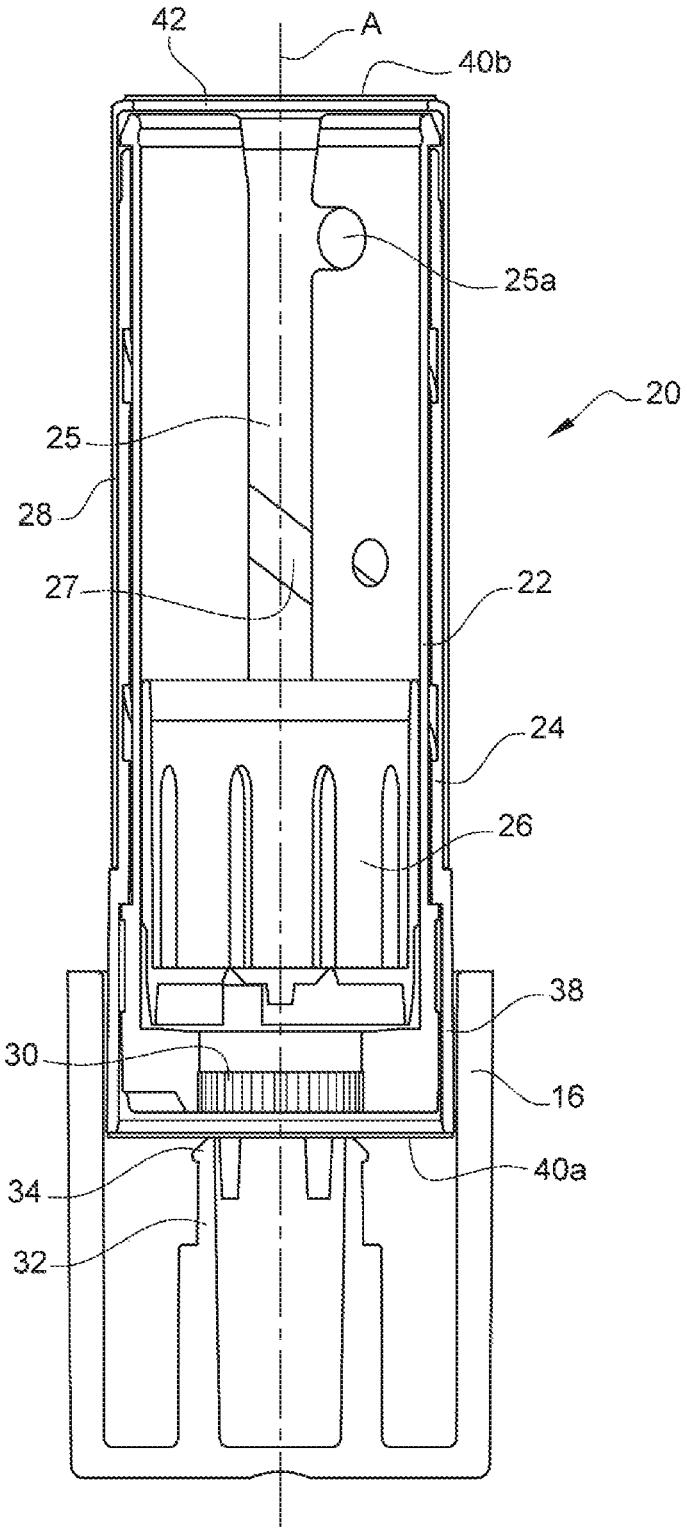

[Fig.4]
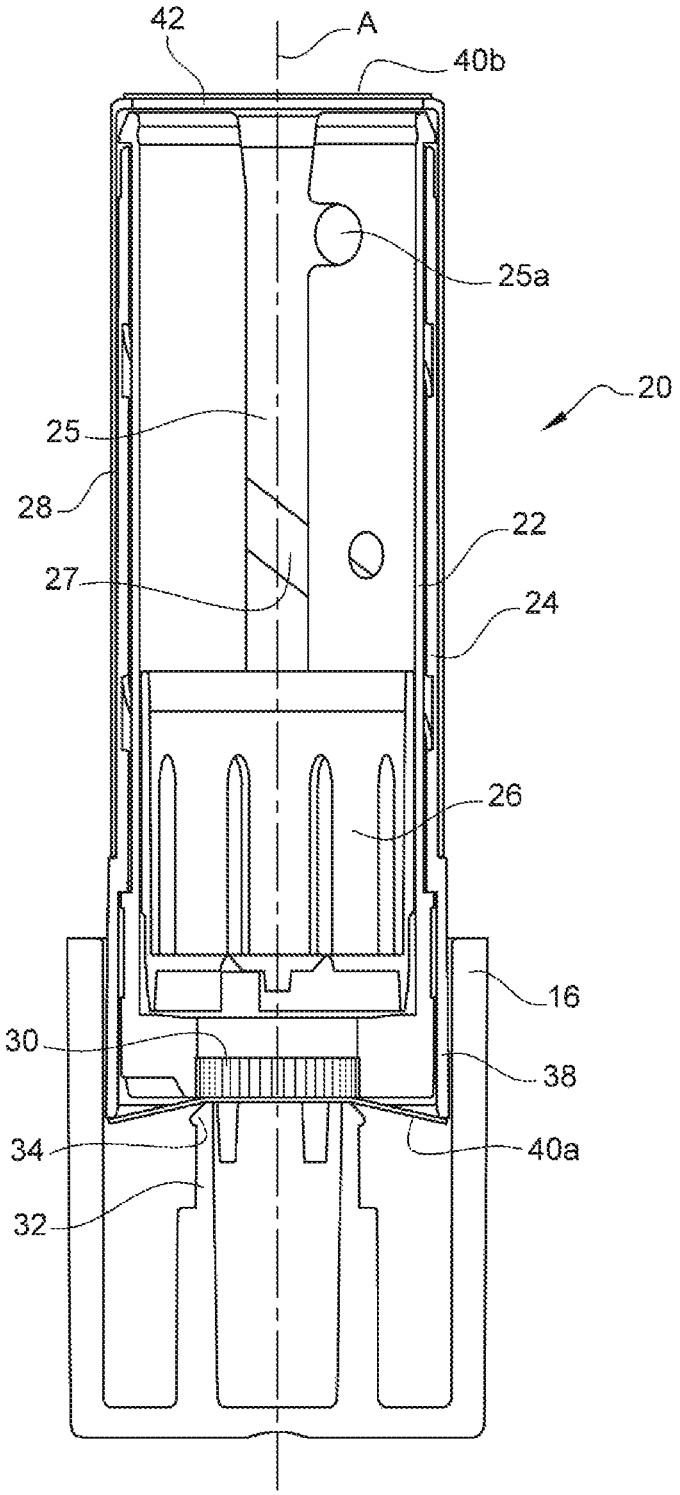

[Fig.5]
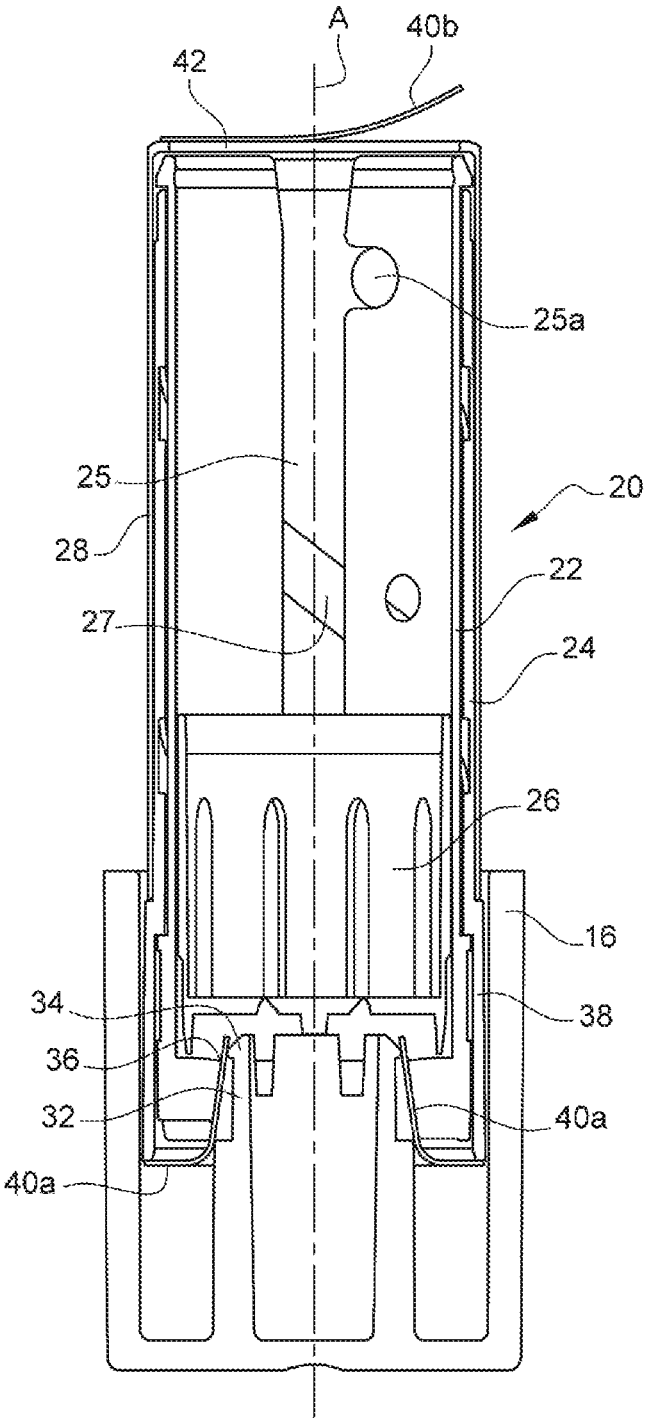

[Fig.6]
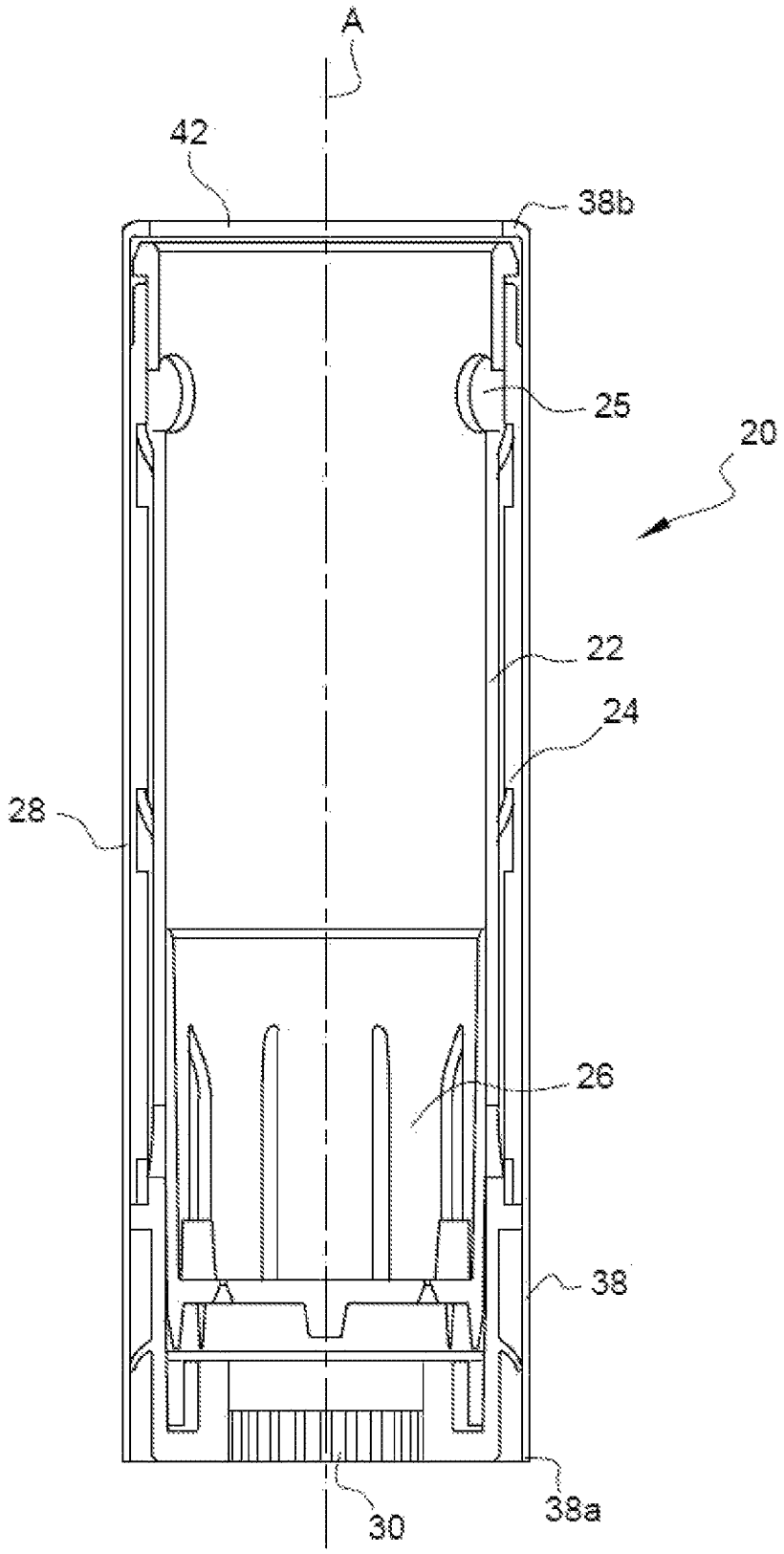

CONTAINER FOR A COSMETIC PRODUCT AND REFILL FOR SUCH A CONTAINER

CROSS REFERENCE TO RELATED APPLICATIONS

The present application claims the benefit of priority to French Patent Application No. 1909855 filed on Sep. 6, 2019 and Chinese Patent Application No. 202010065561.5 filed on Jan. 20, 2020, the disclosures of all of which are hereby incorporated by reference in their entireties.

BACKGROUND OF THE INVENTION

Field of the Invention

The present invention relates to a refill intended to be removably mounted in a container for cosmetic product, in particular for a cosmetic product stick, and relatedly, to a container for a cosmetic product including at least one such refill.

Description of the Related Art

From the state of the art, examples of containers are known for a cosmetic product including a dispensing unit, termed "interchangeable".

By comparison with a single-use container, such a container is characterised by the fact of being refillable, i.e. designed to make it possible to change the dispensing unit, in particular, but not exclusively after a complete use of the cosmetic product.

The interchangeability of the dispensing unit makes it possible to also use, independently of a complete use, a single container with several dispensing units each including, for example, a different cosmetic product such as a lipstick with a given shade.

Such a design makes it possible to conserve the cap and the base of the container which is particularly advantageous when these parts are made of precious and/or decorated materials, for example covered with a covering, which, by comparison, is made of parts which are more expensive to produce.

In addition, the cap and the base are external parts which can be seen from the container which determine the general appearance thereof and consequently, its originality.

In such a container, the interchangeable dispensing unit of the cosmetic product consists of, in particular, a refill or cartridge which could be freely changed.

Outside the container, refills conventionally include an actuation unit making it possible for retraction and/or extension of the cosmetic product. Generally, an actuation means is made available to the handler who can actuate it without the refill being inserted in the base of the container, which can lead to an unintentional extension of the cosmetic product.

Moreover, the cosmetic product is no longer protected by the cap and/or the actuation base, which can lead to it being damaged.

There is therefore a need for a solution making it possible to mitigate at least some of the disadvantages of the prior art, while providing a unit which is interchangeable and advantageously simple and economical to produce.

BRIEF SUMMARY OF THE INVENTION

Thus, the invention relates to a refill intended to be removably mounted on an actuation base, the refill including a cosmetic product stick and a sleeve inside which the stick is movably mounted. The sleeve is closed by at least one lid.

The presence of at least one lid makes it possible to ensure sealing of the refill and to protect the cosmetic product stick as it is not inserted in a container and protected, for example, by a cap or a base of the container. Moreover, the lid is also used as a first use control. The presence of the lid ensures that the refill has not also been used, i.e. inserted in a container.

The refill further includes an actuation unit making it possible for an entry and/or an exit of the cosmetic product stick. The sleeve thus extends along the actuation unit so as to prevent its actuation.

According to different embodiments of the invention, which can be taken together or individually:

- the at least one lid is situated at a proximal end of the sleeve,
- the at least one lid is situated at a distal end of the sleeve,
- the at least one lid is a heat-meltable film,
- the at least one lid is configured to be removed manually,
- the at least one lid is configured to be perforated,
- the at least one lid is configured to be perforated by an element external to the refill,
- the external element is the actuation base furthermore configured to perforate the lid situated at the proximal end of the sleeve,
- the external element is a cap of a container for a cosmetic product stick furthermore configured to perforate the lid situated at the distal end of the sleeve,
- the at least one lid is configured to be perforated by the actuation base,
- the at least one lid is configured to be perforated by the cap,
- the lid situated at the proximal end of the sleeve is configured to be perforated by the actuation base,
- the lid situated at the distal end of the sleeve is configured to be removed manually,
- the proximal end of the sleeve has a zero or positive axial offset with respect to the actuation unit,
- the actuation unit includes an internal guide and a cup carrying the cosmetic product stick,
- the refill includes an external sheath surrounding the internal guide,
- the refill includes a casing integral in rotation with the external sheath,
- the rotational movement of the internal guide with respect to the external sheath causes an axial movement of the cup,
- the sleeve is the external sheath,
- the sleeve is the casing.

The invention also relates to a container for a cosmetic product stick, including a refill such as described above and an actuation base making it possible for retraction and/or extension of the cosmetic product stick, the refill being configured to be removably mounted on the actuation base.

Advantageously, the container includes a cap, such as mentioned above.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is an axial cross-sectional view which represents a container after mounting of a first example of a refill according to the invention on an actuation base of the container;

FIG. 2 is an axial cross-sectional view which represents the refill of FIG. 1 including two closed lids;

FIG. 3 is an axial cross-sectional view which represents the refill of FIG. 2 during mounting on the actuation base of the container of FIG. 1;

FIG. 4 is an axial cross-sectional view which represents the refill of FIG. 2 during mounting on the actuation base of the container of FIG. 1;

FIG. 5 is an axial cross-sectional view which represents the refill of FIG. 2 mounted on the base of the container of FIG. 1 after boring the lower lid, the upper lid being during opening;

FIG. 6 is an axial cross-sectional view which represents a second example of a refill according to the invention.

DETAILED DESCRIPTION OF THE INVENTION

By convention, the "axial" direction corresponds to that of main extension of the container, illustrated by the axis A in the figures and the "radial" direction is orthogonal to the axial direction.

In the following detailed description of the figures, in a non-limiting manner, the terms "upper" and "lower" or also "top" and "bottom" will be used with reference to the axial direction.

In the same manner, the terms "outer or external" and "inner or internal" are used with reference to the radial direction, an external element being radially farther away from the axis A than an internal element.

In the following description, elements having an identical structure or similar functions will be designated by the same references.

In FIGS. 1 and 3 to 5, an example embodiment of a container 10 has been represented, also called case, of a cosmetic product stick 12.

In the example embodiment, the cosmetic product stick 12 is a lipstick intended to be applied by friction, in one variant, a labial treatment balm.

The container 10 includes at least one cap 14 which is associated with an actuation base 16 having a complementary shape, the base and the cap together defining an external edge of the container.

The container 10 further includes a refill 20 for dispensing the cosmetic product stick 12.

In a non-limiting manner, the cap 14, the base 16 of the container 10 and the refill 20 have a cylindrical, circular cross-sectional shape, which cannot be seen.

Preferably, the cap 14 is removable. The cap 14 is likely to occupy at least one opening position in which the cap 14 is separated from the base 16, in particular making it possible to apply the cosmetic product (FIGS. 3 to 5) and a closing position in which the cap 14 is integral with the base 16 (FIG. 1).

The lower portion of the cap 14 includes inside, at least one annular bulge 18 which is intended to engage with an external cylindrical surface of the refill 20.

Advantageously, the annular bulge 18 keeps the cap 14 in a closing position and contributes to obtaining an airtight closing in order to guarantee good conservation of the cosmetic product stick 12, during the use of the refill 20.

The cap 14 includes a lower edge 19 which is likely to abut against an upper edge 17 of the actuation base 16 in a closing position.

In an embodiment, not represented, the base 16 can include a shoulder which extends radially at the level of the connection of the upper portion of the base 16 with a lower portion of a larger diameter. The lower edge of the cap 14 is thus likely to abut against the shoulder in closed position.

Two example embodiments of the refill 20 are illustrated in FIGS. 2 and 6.

The refill 20 has a main axis which extends along the axial direction, coincident with the main axis A of the container 10.

The refill 20 is intended to be removably mounted on an actuation base 16, for example the actuation base 16 of the container 10 for cosmetic product described above.

The refill 20 is intended to be changeable, in particular but not exclusively after the complete use of the cosmetic product stick 12.

The refill 20 and the extension and/or retraction mechanism thereof of the cosmetic product stick 12 described above are only given as a non-limiting example.

In the two example embodiments, the refill 20 includes an internal guide 22 the rotational movement of which with respect to an external sheath 24 causes an axial movement of a cup 26 carrying the cosmetic product stick 12.

The internal guide 22 and the cup 26 form an actuation unit 22, 26 of the refill 20 making it possible for retraction and/or extension of the cosmetic product stick 12.

The cup 26 includes at least one lug (not visible), preferably two diametrically opposite lugs.

The lugs engage respectively with sliders 25 of the internal guide 22, the sliders 25 extend axially rectilinearly. Each slider 25 advantageously includes, at each of the upper and lower ends thereof, an angular notch 25*a* forming an end position abutment for the lugs of the cup 26.

The external sheath 24 surrounds the internal guide 22 over all or some of its length.

In the first example embodiment illustrated in FIGS. 1 to 5, the external sheath 24 extends over the whole length of the internal guide 22.

In the second example embodiment illustrated in FIG. 6, the external sheath 24 extends over only a portion of the length of the internal guide 22 and exposes a lower portion of it.

The external sheath 24 internally includes two helicoidal grooves 27 with which the free end of the lugs respectively engages, each lug radially passing through the slider 25 associated with the internal guide 22 to be engaged in a groove 27.

The refill 20 also here includes a casing 28, also called jacket, which is force-fitted or glued to the outside of the external sheath 24, and integral in rotation with the external sheath 24.

The casing 28 surrounds the internal guide 22 and the external sheath 24 over all of some of the length thereof.

In the first example embodiment illustrated in FIGS. 1 to 5, the casing 28 extends over only a portion of the length of the internal guide 22 and of the external sheath 24 and exposes a lower portion of the external sheath 24 which covers the lower portion of the internal guide 22.

In the second example embodiment illustrated in FIG. 6, the casing 28 extends over the whole length of the internal guide 22 and of the external sheath 24. The casing 28 thus covers the lower portion of the internal guide 22 which is not covered by the external sheath 24.

The internal guide 22 includes a scroll wheel 30. The scroll wheel 30 is situated axially at the lower end of the internal guide 22.

The scroll wheel 30 is intended to make it possible for the internal guide 22 to rotate causing, according to the direction of rotation, an axial raising or lowering movement of the cup 26 and in doing so, the cosmetic product stick 12.

Preferably, the scroll wheel 30 is made integrally in one piece with the internal guide 22 of the refill 20. In a variant, the scroll wheel 30 is a separate part attached to fixing on the internal guide 22.

In such a container 10, the scroll wheel 30 of the refill 20 is actuated, after having removed the cap 14 beforehand, by way of the base 16.

Consequently, the scroll wheel 30 and the base 16 must, on the one hand, be connected axially together, and on the other hand, be rotatably connected to ensure the transmission to the scroll wheel 30 of the refill 20 of any rotational movement applied to the base 16.

For this, the actuation base 16 includes fixing means 32 to axially connect the actuation base 16 with the scroll wheel 30 of the refill 20.

The fixing means 32 include four pads 32 which extend axially towards the top from a lower portion of the actuation base 16.

The four pads 32 of the actuation base 16 are angularly distributed regularly, that is at 90°. The pads 32 are inserted in a complementary orifice which is arranged centrally in the scroll wheel 30 of the refill 20.

The free end of each pad 32 is configured to form a hook 34 which engages with an upper edge 36 of the orifice of the scroll wheel 30 in order to axially block the actuation base 16.

The fixing pads 32 make it possible to axially connect the actuation base 16 to the scroll wheel 30 of the refill 20, the blocking in rotation being carried out by a complementary notching of the scroll wheel 30 and of the pads 32.

The refill 20 includes a sleeve 38 inside which the cosmetic product stick 12 is movably mounted, the sleeve 38 being closed by at least one lid 40*a*, 40*b* as is illustrated in FIGS. 1 to 5.

The sleeve 38 is a cylindrical element extending from a proximal end 38*a* to a distal end 38*b*. Preferably, the shape of the sleeve 38 is similar to the general shape of the refill 20.

Preferably, the proximal end 38*a* is situated towards the proximity of the scroll wheel 30 and the distal end 38*b* is situated towards the proximity of an opening 42 of the refill 20.

The lid 40*a*, 40*b* can be situated at the proximal end 38*a* and/or the distal end 38*b* of the sleeve 38.

The lid 40*a*, 40*b* thus makes it possible to ensure sealing of the refill 20 and protection of the cosmetic product stick 12 before it is inserted in the container 10, and in particular, assembled with the actuation base 16 of the container 10. The cosmetic product will thus be protected by the cap 14 and the actuation base 16.

The sleeve 38 furthermore extends along the actuation unit 22, 26 so as to prevent its actuation. In other words, the sleeve 38 is extended such that the scroll wheel 30 is covered and inaccessible, in particular by the user, including before mounting on the actuation base 16.

Preferably, the proximal end of the sleeve 38 has a zero or positive axial offset d with respect to the actuation unit (see FIG. 2). The length of the sleeve 38 is thus equal to or greater than at least a few tenths of millimetres to the length of the actuation unit 22, 26 at least at the level of the proximal end, and more specifically to the length of the internal guide 22.

Advantageously, a first one of the lids 40*a*, 40*b* or lower lid 40*a*, can thus be fixed on the proximal end 38*a* of the sleeve 38. This first lid 40*a* makes it possible, not only to ensure sealing of the refill 20 and the protection of the cosmetic product stick 12 before it is protected by the actuation base 16, but it is also a visual tamper control. The presence of the first sealed lid 40*a* makes it possible to ensure that the refill 20 has also not been used. Moreover, this first lid 40*a* makes it possible to avoid the scroll wheel 30 being actuated before the refill 20 is inserted in the dedicated container 10.

An additional lid 40*b* can be fixed to the distal end 38*b* of the refill 20.

This second lid 40*b*, or upper lid 40*b*, can be arranged on the distal end 38*b* of the sleeve 38 or on another element of the refill 20 towards the distal end thereof, i.e. towards the opening 42 of the refill 20.

Advantageously, the second lid 40*b* situated towards the distal end of the refill 20 makes it possible to ensure sealing of the refill 20 and protection of the cosmetic product stick 12 before it is protected by the cap 14 of the container 10. The second lid 40*b* is also used as a visual tamper control. The presence of the sealed second lid 40*b* makes it possible to ensure that the refill 20 has not also been used.

Preferably, the lid(s) 40*a*, 40*b* is/are a heat-meltable film. It can be a heat-meltable film well known to a person skilled in the art.

Preferably, the lid(s) 40*a*, 40*b* is/are configured to be removed manually or to be perforated, in particular by an element external to the refill 20, in particular an element of the container 10. The first lid 40*a* can thus be perforated by the actuation base 16 when the refill 20 is mounted on it. The second lid 40*b* can be perforated by the cap 14 during the first use of the cap 14, i.e. when the container 10 is closed after the first insertion of the refill 20 in the container 10.

Advantageously, the first lid 40*a* is perforated by the actuation base 16 and the second lid 40*b* is removed manually by the user, without this being limiting.

When the refill 20 is inserted in the actuation base 16, it, especially the pads 32 protruding from the actuation base 16, presses on the first lid 40*a* (FIG. 4), until it is perforated by the actuation base 16 when the refill 20 is completely assembled to the actuation base 16.

It can be envisaged that the two lids 40*a*, 40*b* are removed manually or that the two lids 40*a*, 40*b* are perforated by an external element of the refill 20, in particular, an element of the container 10.

In the first example embodiment represented in FIGS. 1 to 5, the component of the sleeve 38 closed by the lids 40*a*, 40*b* and preventing actuation of the cosmetic product stick 12 is the external sheath 24.

The external sheath 24 extends along the actuation unit 22, 26, in particular along the internal guide 22. The external sheath 24 is thus extended at the level of the proximal portion such that the scroll wheel 30 is covered and inaccessible by the user before the refill 20 is installed in the container 10. The actuation unit 22, 26 cannot be actuated without the use of an external element, such as the actuation base 16 of the container 10 described above.

Advantageously, the external sheath 24 has an axial offset d with respect to the internal guide 22. In other words, a distance d can be measured between the proximal end of the external sheath 24 and the proximal end of the internal guide 22. The distance d is, here, one millimetre. Thus, the scroll wheel 30 is covered and inaccessible.

The first lid 40*a* can thus be easily fixed to the proximal end of the external sheath 24 as illustrated in FIGS. 2 to 6. The first lid 40*a* is configured to be perforated by the actuation base 16.

In the first example embodiment represented in FIGS. 1 to 5, the refill 20 includes two lids 40*a*, 40*b*.

The second lid 40*b* is present at the distal end of the container 10 as can be seen in FIGS. 2 to 5.

In this first example embodiment, the second lid 40*b* is configured to be removed manually by the user. The second lid 40*b* can be removed before or after the insertion of the refill 20 in the actuation base 16. Here, the second lid 40*b* is removed after the mounting of the refill 20 in the actuation base 16.

In a second example embodiment represented in FIG. 6, the component of the sleeve 38 and preventing the actuation of the cosmetic product stick 12 is the casing 28. It can be closed at one or each end by the lids 40*a*, 40*b*.

Similar to the external sheath 24, the casing 28 is thus extended such that the scroll wheel 30 is covered and inaccessible by the user before the refill 20 is installed in the container 10. The casing 28 extends along the actuation unit 22, 26, in particular along the internal guide 22. The actuation unit 22, 26 cannot be actuated without using an external element, such as the actuation base 16 of the container 10 described above.

Advantageously, the casing 28 may have an axial offset relative to the external sheath 24 and/or to the internal guide 22. A first lid 40*a* can thus be easily fixed to the proximal end thereof.

Likewise, a second lid 40*b* can be fixed to the distal end of the casing.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A refill intended to be removably mounted on an actuation base, said refill comprising:

a cosmetic product stick and a sleeve inside which said stick is movably mounted, wherein said sleeve is closed by at least one lid, the refill further comprises an actuation unit making it possible for retraction and/or extension of the cosmetic product stick, the sleeve extending along the actuation unit so as to prevent its actuation.

2. The refill according to claim 1, wherein the at least one lid is situated at a proximal end and/or at a distal end of the sleeve.

3. The refill according to claim 1, wherein the at least one lid is a heat-meltable film.

4. The refill according to claim 1, wherein the at least one lid is configured to be removed manually and/or perforated by an element external to the refill.

5. The refill according to claim 4, wherein the external element is the actuation base further configured to perforate the lid situated at the proximal end of the sleeve.

6. The refill according to claim 5, wherein the lid situated at the distal end of the sleeve is configured to be removed manually.

7. The refill according to claim 2, wherein the proximal end of the sleeve has a zero or positive axial offset with respect to the actuation unit.

8. The refill according to claim 7, wherein the actuation unit comprises an internal guide and a cup carrying the cosmetic product stick, the refill comprising an external sheath surrounding the internal guide and optionally a casing integral in rotation with the external sheath, the rotational movement of the internal guide with respect to the external sheath causing axial movement of the cup.

9. The refill according to claim 8, wherein the sleeve is the external sheath.

10. The refill according to claim 2, wherein the sleeve is a casing.

11. A container for a cosmetic product stick, comprising:

a refill comprising a cosmetic product stick and a sleeve inside which said stick is movably mounted, wherein said sleeve is closed by at least one lid, the refill further comprises an actuation unit making it possible for retraction and/or extension of the cosmetic product stick, the sleeve extending along the actuation unit so as to prevent its actuation; and an actuation base making it possible for retraction and/or extension of the cosmetic product stick, said refill being configured to be removably mounted on the actuation base.

12. A refill intended to be removably mounted on an actuation base, said refill comprising:

a cosmetic product stick and a sleeve inside which said stick is movably mounted, wherein the refill further comprises an actuation unit making it possible for retraction and/or extension of the cosmetic product stick, the sleeve extending along the actuation unit so as to prevent its actuation.

* * * * *